US005592756A

United States Patent [19]

Decker

[11] Patent Number: 5,592,756

[45] Date of Patent: Jan. 14, 1997

[54] ANKLE SUPPORTING SYSTEM FOR ATHLETIC FOOTWEAR INCLUDING MATING ARTICULATION SURFACES

[76] Inventor: John W. Decker, 30 Somerdale St., Spotswood, N.J. 08884

[21] Appl. No.: 497,862

[22] Filed: Jul. 3, 1995

[51] Int. Cl.[6] ..... A43B 7/20; A43B 5/04; A43B 5/16

[52] U.S. Cl. ..... 36/89; 36/115; 36/120

[58] Field of Search ..... 36/120, 71, 55, 36/88, 89, 140, 115, 93, 85, 87, 96, 107, 109

[56] References Cited

U.S. PATENT DOCUMENTS

| | | | |
|---|---|---|---|
| 1,549,382 | 8/1925 | Riddell | 36/89 |
| 2,444,428 | 7/1948 | Carrier | 36/89 X |
| 3,636,642 | 1/1972 | Walther | 36/120 |
| 3,750,310 | 8/1973 | Messner et al. | 36/93 X |
| 4,019,266 | 4/1977 | Hanson et al. | 36/71 X |
| 4,107,856 | 8/1978 | Bourque | 36/115 |
| 5,175,947 | 11/1993 | Parracho | 36/89 |
| 5,185,000 | 2/1993 | Brandt et al. | 36/89 X |
| 5,438,769 | 8/1995 | Mazzarolo | 36/89 X |

FOREIGN PATENT DOCUMENTS

| | | | |
|---|---|---|---|
| 93895 | 3/1923 | Germany | 36/89 |

*Primary Examiner*—B. Dayoan
*Attorney, Agent, or Firm*—Brian K. Dinicola

[57] ABSTRACT

An article of athletic footwear or legwear comprises a flexible interior member manipulable to receive at least a portion of a wearer's foot and a first pair of disk members coupled to opposed exterior surface portions of the flexible interior member and positionable over the lateral and medial sides of the ankle joint. Each disk member defines a substantially convex, outwardly facing exterior surface portion.

The article, which may be an athletic shoe, ski boot, skate, or the like, further comprises an exterior assembly defining an interior cavity dimensioned and arranged to receive the flexible interior member while the interior member is worn on the foot of the wearer. A second pair of disk members are coupled to opposite interior surface portions of the exterior assembly within the cavity. Each disk member of the second pair has a substantially concave exterior surface portion dimensioned and arranged to receive the convex exterior portion of a corresponding disk member of the first pair in complementary engagement. Accordingly, each disk of the first pair is rotatably engageable with a corresponding disk of the second pair. This interlocking arrangement of rotatable disks results in a system which allows the ankle to rotate about an axis, while transferring axial loads to the ankle.

7 Claims, 1 Drawing Sheet

ANKLE SUPPORTING SYSTEM FOR ATHLETIC FOOTWEAR INCLUDING MATING ARTICULATION SURFACES

BACKGROUND OF THE INVENTION

1. Field of The Invention

The present invention relates generally to articles of footwear and legwear and, more particularly, to articles of footwear and legwear which incorporate ankle supporting structures.

2. Description of the Prior Art

For optimum performance during athletic activity, articles of footwear and legwear must be designed to provide a unique and specific combination of support, protection, and, if applicable, traction. Athletic shoes, skates, and ski boots, for example, are designed for specific sports and also to meet the specific characteristics of the user.

Extensive studies have shown that the joints of the foot involve complex mechanisms which provide for extension and flexion movement as well as for rotary movement. These movements result from both a rotating and sliding movement as well as a pivoting movement in the knee and ankle joints. A detailed discussion of the ankle and foot joints appears in V. H. Frankel and M. Nordin, "Basic Biomechanics of the Skeletal System," Chapters 6 and 7, Lea & Febiger, Philadelphia, 1980.

To accommodate athletic activities in which the athlete must make sudden and rapid lateral movements, such as in basketball, football, tennis or ice hockey, the upper of the article typically extends above the ankle bones (the medial and lateral malleoli). Such articles are referred to as three-quarter height or high top footwear. Attaining a proper fit around the ankle bones in athletic footwear and legwear has been a problem because of the uneven contour around the ankle bones varies from person to person. The typical prior art technique for fitting the upper around the ankle bones has been to line the ankle portion of the upper with a relatively soft foam material. However, since no two persons have precisely the same ankle bone configuration, the foam material only approximates a customized fit. Moreover, this arrangement does not provide axially distributed support of the ankles and can not be worn tightly over the foot without interfering without discomfort or loss of mobility.

SUMMARY OF THE INVENTION

According to the present invention, the above-identified deficiencies are overcome by articles of legwear or footwear in which complementary disk structures aligned with the joints of the ankle are utilized to distribute all transverse loads in an axial direction relative to the ankle, in the direction of the joint.

An illustrative embodiment of the present invention comprises a flexible interior member manipulable to receive at least a portion of a wearer's foot and a first pair of disk members coupled to opposed exterior surface portions of the flexible interior member and positionable over the lateral and medial sides of the ankle joint. Each disk member preferably defines a substantially convex, outwardly facing exterior surface portion.

The article, which may be an athletic shoe, ski boot, skate, or the like, further comprises an exterior member dimensioned and arranged to receive the flexible interior member while the interior member is worn on the foot of the wearer. A second pair of disk members are coupled to opposite interior surface portions of the exterior member. Each disk member of the second pair has a substantially concave exterior surface portion dimensioned and arranged to receive the convex exterior portion of a corresponding disk member of the first pair in complementary engagement. Accordingly, each disk of the first pair is rotatably engageable with a corresponding disk of the second pair. This interlocking arrangement of rotatable disks results in a system which allows the ankle to rotate about an axis, while transferring axial loads to the ankle.

By employing relatively rotatable disks to distribute axial loads, footwear constructed in accordance with the present invention can be worn more tightly than prior art configurations without affecting performance or causing discomfort.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

An illustrative article of footwear incorporating the ankle supporting system of the present invention is depicted in FIGS. 1–4. For purposes of the present discussion, the term footwear should be understood to include, but not be limited to, ski boots, ice skates, roller skates, rehabilitative equipment, and athletic shoes. Accordingly, although only one embodiment is illustrated and described in detail, it will be readily appreciated by those skilled in the art that the ankle supporting system of the present invention can, with certain minor variations, be adapted to a wide variety of applications in which ankle support is desired or required.

Figure 1:
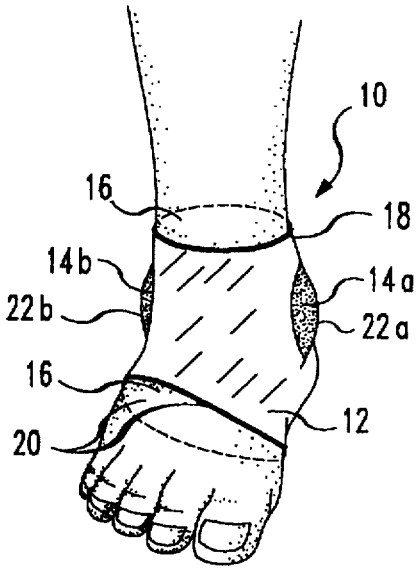
FIG. 1 is a front perspective view of the flexible interior member of an ankle supporting system constructed in accordance with an illustrative embodiment of the present invention, the flexible member being shown properly positioned over the foot of a wearer.
Figure 2:
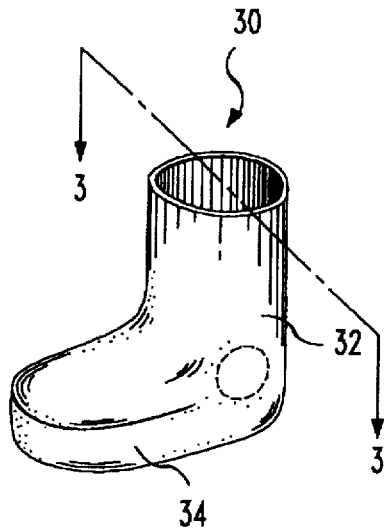
FIG. 2 is a side elevation view of an article of athletic footwear modified for use with the interior member of FIG. 1.

With reference now to FIGS. 1 and 2, there are shown, respectively, the interior and exterior components of an article of ankle-supporting footwear constructed in accordance with the present invention. Turning first to FIG. 1, interior ankle supporting assembly 10 comprises a body portion 12 and a first pair of disk members 14*a* and 14*b*. Body portion 12 is manipulable into the position shown to cover at least an intermediate portion of the foot while positioning disk members 14*a* and 14*b* over the medial and lateral sides, respectively, of the ankle joint. Preferably, body portion 12 is designed to fit snugly about the ankle area of the user and is constructed from a stretchable material.

Appropriate materials such as natural latex rubber and expanded neoprene of the type commonly used in such applications as diver's wetsuits are suitable for this purpose. The materials of fabrication of the body portion may vary but the main characteristic of the material is that the material should have elastic properties so that the material will stretch to snugly engage the foot of the wearer to provide suitable alignment of disk members 14*a* and 14*b*. The material may also be a laminate material with suitable laminations to allow the material to properly breath, absorb moisture and resist wear. In some cases a stretchable sock or stocking may be suitable.

As seen in FIG. 1, body portion 12 defines an interior opening 16 which receives the foot and ankle of the wearer. The upper edge 18 of the body member extends to an area at least above the ankle bone of the wearer. In the illustrative embodiment, the body portion 12 is a generally tubular member extending downwardly and conforming to the general shape of the foot of the user in an L-shape. The body portion terminates at a forward edge 20 which, as shown in FIG. 1, corresponds to a location generally corresponding to the cuboid bone.

Disk members 14*a* and 14*b* are, as shown in FIG. 1, fastened or otherwise secured to body portion 12 so as to project outwardly, in substantially opposite directions, from the exterior surface thereof. For a purpose which will be explained later, each of disk members 14*a* and 14*b* is preferably comprised of a durable plastic material having a low coefficient of friction but sufficient hardness to resist deflection. Each of disk members 14*a* and 14*b* has a substantially convex, outwardly facing exterior surface 22*a*, 22*b* and, preferably, a substantially concave inwardly facing surface (not shown).

To ensure that the interior ankle supporting assembly 10 conforms to the geometry of the wearer's ankle, the inwardly facing surfaces of disk members 14*a*, 14*b* are preferably padded with a soft material. The necessity for supplementary padding may, of course, depending upon the manner in which the disk members are secured to body portion 12 and to the material selected in fabricating body portion 12. For example, if inwardly facing surfaces 24*a*, 24*b* are secured, as by adhesive, stitching, or other suitable means, to the exterior surface of body portion 12, those sections of body portion 12 disposed between each disk member and the corresponding ankle joint may provide adequate padding to conform to the joint surfaces. Alternatively, however, if the disk members are attached so that they are concentrically arranged over apertures defined in body portion 12, padding should be provided on the inwardly facing disk member surfaces. In any event, it will be readily ascertained that when worn in the manner shown in FIG. 1, the outwardly facing convex surfaces 22*a*, 22*b* of disk members 14*a*, 14*b* are axially aligned with the ankle joint of the wearer.

Figure 3:
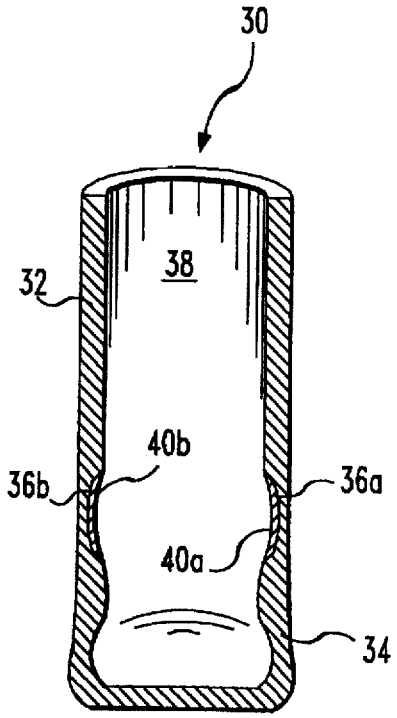
FIG. 3 is a front view of the article of FIG. 2 taken in cross-section across line 3—3 in FIG. 2.

In FIGS. 2 and 3, there is shown an illustrative example of an article of footwear 30 modified in accordance with the present invention to interact with the ankle supporting assembly 10 of FIG. 1. As indicated above, footwear article 30 may be an athletic shoe, ice skate, roller skate or other like. In the illustrative embodiment of FIGS. 2 and 3, however, footwear article 30 is configured as a ski boot and includes an upper portion 32 and a sole portion 34.

For a purpose which will soon become apparent, footwear article 30 defines an interior cavity 38 dimensioned and arranged to receive interior ankle support assembly 10 while the latter is being worn on the foot of the wearer. Within cavity 38, a second pair of disk members 36*a* and 36*b* are coupled to opposite interior surface portions. Each disk member 36*a*, 36*b* is preferably comprised of the same durable, low friction material as utilized in the construction of disk members 14*a*, 14*b*. Each disk member 36*a*, 36*b* also includes an inwardly facing, concave surface portion 40*a*, 40*b*.

Figure 4:
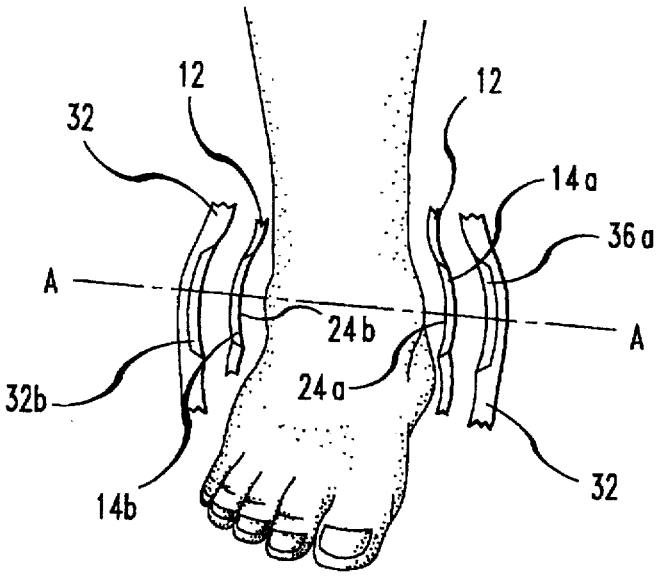
FIG. 4 is an exploded partial perspective view depicting the inventive arrangement of inner and outer disk members relative to the medial and lateral sides of an ankle joint.

As best seen in FIG. 4, the concave surfaces of outer disk members 36*a*, 36*b* dimensionally complements the convex exterior surfaces of interior disk members 14*a*, 14*b*, respectively. As such, each interior disk member is rotatably engageable with a corresponding exterior disk member. Advantageously, this interlocking arrangement results in a system which permits the ankle to rotate about a transverse axis, while distributing the axial component of all transverse loads over the entire area of the ankle joint.

While there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

What is claimed is:

1. An article of footwear for providing support to an ankle joint of a wearer, the ankle joint having a lateral and a medial side, comprising:

an interior assembly including a flexible body portion manipulable to receive at least a portion of a wearer's foot;

a first disk member coupled to said flexible body portion and projecting from an exterior surface portion thereof, said first disk member being positionable over one of the lateral or medial side of the ankle joint and defining a substantially convex exterior surface portion;

an exterior assembly defining an interior cavity dimensioned and arranged to receive said flexible body portion while said interior member is worn on the foot of the wearer, said exterior assembly including a sole and an upper; and a second disk member coupled to said exterior assembly and disposed within said interior cavity, said second disk member having a substantially concave interior surface portion dimensioned and arranged to receive said convex exterior surface portion in substantially complementary engagement, whereby axial loads are directed toward a wearer's ankle joint and distributed over an area defined by said first and second disk members, wherein said interior assembly is movable, while worn on the foot of the wearer, from a position external to the interior cavity into a second position within said cavity in which the first and second disk members are aligned.

2. The article of claim 1, further including a third disk member coupled to said flexible body portion and positionable over the other of the medial and lateral sides of the ankle joint, said third disk member defining a substantially convex exterior surface portion facing a direction substantially opposite the convex exterior surface portion of said first disk member; and a fourth disk member coupled to said exterior assembly and disposed within said interior cavity, said fourth disk member having a substantially concave interior surface portion dimensioned and arranged to receive the convex exterior portion of said third disk member in substantially complementary engagement, whereby axial loads are directed toward the lateral and medial sides of a wearer's ankle joint.

3. The article of claim 1, wherein said flexible body portion is comprised of an elastic material.

4. The article of claim 3, wherein said flexible body portion has a substantially tubular shape.

5. The article of claim 2, wherein said first and third disk members are adhesively secured to said flexible body portion.

6. The article of claim 2, wherein said first and third disk members are stitched to said flexible interior member.

7. The article of claim 2, wherein said exterior member is a ski boot.

* * * * *